US005775007A

United States Patent [19]

Exposé

[11] Patent Number: 5,775,007

[45] Date of Patent: Jul. 7, 1998

[54] HEEL PROTECTOR

[76] Inventor: Darell Exposé, 3326 Spain St., New Orleans, La. 70122

[21] Appl. No.: 816,311

[22] Filed: Mar. 13, 1997

[51] Int. Cl.[6] ..... A43B 23/30

[52] U.S. Cl. ..... 36/72 B; 36/136

[58] Field of Search ..... 36/72 B, 136

[56] References Cited

U.S. PATENT DOCUMENTS 4,459,764 7/1984 Beck .

FOREIGN PATENT DOCUMENTS 2250268 7/1975 France .
2142813 1/1985 United Kingdom .
2215180 9/1989 United Kingdom .

*Primary Examiner*—Ted Kavanaugh
*Attorney, Agent, or Firm*—Joseph N. Breaux

[57] ABSTRACT

A protective device for the heel and back portion of a footwear article including a cover member, at least two user adjustable straps for securing the cover member to a footwear article, and a sealable pouch attached to the cover member. The cover member has a curved exterior surface portion and includes a padded, recessed area for receiving at least a portion of the heel and back of a footwear article and a elongated heel slot formed through a bottom section of the cover member having a width sufficient to allow a standard high heel to be inserted laterally into the slot in a manner such that the back of the shoe to which the highs heel is attached is disposed within the padded recessed area. The sealable pouch is constructed of flexible plastic and has a central portion permanently affixed to the curved exterior surface portion of the cover member device and two side portions that are detachably securable to the curved exterior surface of the cover member with a restickable adhesive. Attaching the sealable pouch permanently at its center and with a restickable adhesive along its two sides allows the opening of the sealable pouch to be easily opened for inserting and removing a treated polishing cloth that is stored within the sealable pouch for use in touching up and polishing small scuffs and other minor damage to the footwear article. The treated polishing cloth is preferably provided with the protective device.

14 Claims, 3 Drawing Sheets

HEEL PROTECTOR

DESCRIPTION

1. Technical Field

The present invention relates to protective devices for protecting the heel and back portion of a footwear article and more particularly to a protective device for protecting the heel and back portion of a footwear articles, such as boots and high heels, that does not required modification to adapt to various footwear articles and that includes a sealable pouch having a central portion permanently affixed to a curved exterior surface of the protective device and two side portions that are detachably securable to curved exterior surface of the protective device with a restickable adhesive.

2. Background Art

The heel and back portion of footwear articles such as boots and high heeled shoes often receive damage while driving a vehicle. This damage is the result of the angle at which the foot of the driver is oriented while driving. This damage can lead to the premature discarding of otherwise perfectly usable footwear. It would be a benefit therefore Lo have a device that could be attached to a footwear article that would protect the heel and back portion of the footwear article from damage resulting from operation of the vehicle. It would be a further benefit if the protective device could be usable with a variety of different styled footwear without requiring any modification to the protective device. It would be a still further benefit if the protective device could be easily attached and removed.

In addition, because the protective device does not eliminate all scuffing and other marking of tho footwear article, it would also be a benefit to have such a protective device that included a sealable pouch containing a treated polishing cloth that could be easily removed from the pouch used and then reinserted into the sealable pouch for use at a later time.

GENERAL SUMMARY DISCUSSION OF INVENTION

It is thus an object of the invention to provide a device for protecting the heel and back portion of an article of footwear from premature wear caused by operating a motor vehicle while wearing the footwear article.

It is a further object of the invention to provide a protective device for the heel and back portion of an article of footwear that may be utilized with various types of footwear articles without modification of the protective device.

It is a still further object of the invention to provide a protective device for the heel and back portion of an article of footwear that includes a sealable pouch containing a treated polishing cloth that is easily removed from the pouch, used and then reinserted into the sealable pouch for use at a later time.

It is a still further object of the invention to provide a protective device for the heel and back portion of an article of footwear that includes a sealable pouch having a central portion permanently affixed to a curved exterior surface of the protective device and two side portions that are detachably securable to the curved exterior surface of the protective device with a restickable adhesive.

It is a still further object of the invention to provide a protective device for the heel and back portion of an article of footwear that accomplishes some or all of the above objects in combination.

Accordingly, a protective device for the heel and back portion of a footwear article is provided. The protective device comprises a cover member, at least two user adjustable straps for securing the cover member ago a footwear article, and a sealable pouch attached to the cover member. The cover member has a curved exterior surface portion and includes a padded, recessed area for receiving at least a portion of the heel and back of a footwear article and a elongated heel slot formed through a bottom section of the cover member having a width sufficient to allow a standard high heel to be inserted laterally into the slot in a manner such that the back of the shoe to which the high heel is attached is disposed within the padded recessed area. The sealable pouch is constructed of flexible plastic and has a central portion permanently affixed to the curved exterior surface portion of the cover member device and two side portions that are detachably securable to the curved exterior surface of the cover member with a restickable adhesive. Attaching the sealable pouch permanently at its center and with a restickable adhesive along its two sides allows the opening of the sealable pouch to be easily opened for inserting and removing a treated polishing cloth that is stored within the sealable pouch for use in touching up and polishing small scuffs and other minor damage to the footwear article. The treated polishing cloth is preferably provided with the protective device.

In a preferred embodiment, the cover member is constructed of an outer U-shaped member, an inner U-shaped member, and a bottom member. The inner U-shaped member is constructed from a resilient and/or deformable material such as a plastic foam and glued or otherwise secured within the outer U-shaped member. The inner U-shaped member is sized to receive the heel and a portion of the back of a boot or the like. The outer U-shaped member is preferably constructed from a hard plastic material, however, other materials such as leather and vinyl are suitable construction materials.

The bottom member is heel shaped and secured over one side of the U-shaped inner and outer members. An elongated U-shaped slot is formed through the bottom member that runs from a front edge of the bottom member back toward the inner U-shaped member. The bottom member may be constructed from the same materials as the outer U-shaped member. The elongated U-shaped slot is preferably between three quarters of one inch and two inches wide. It should be appreciated that the entire outer portion consisting of the outer U-shaped member and the bottom portion may be integrally formed if desired.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
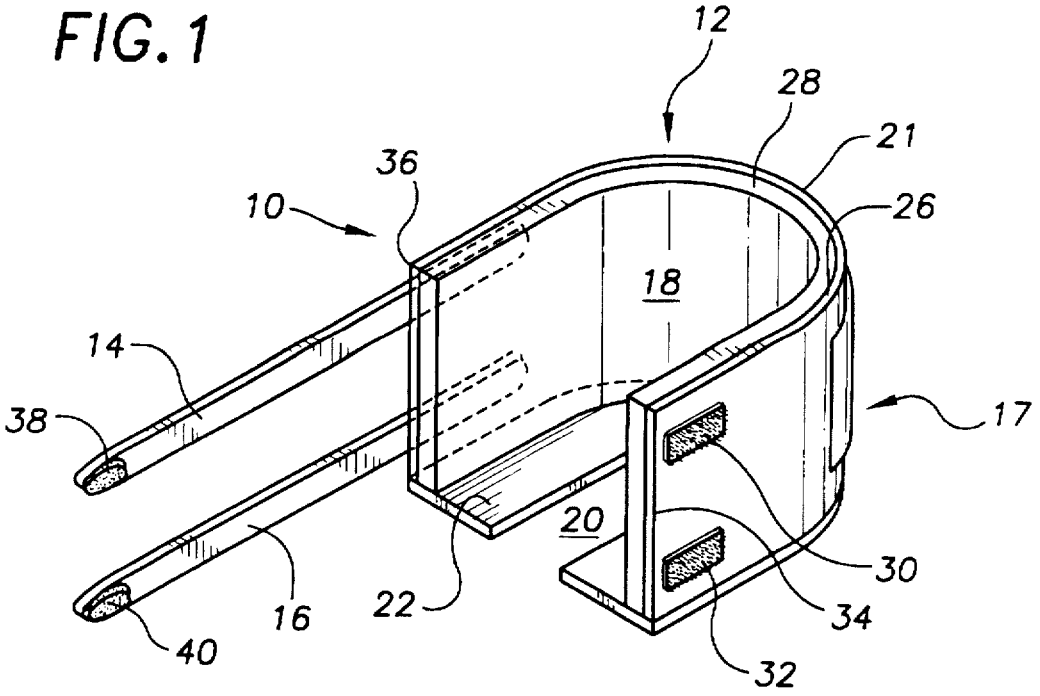
FIG. 1 is a perspective view of an exemplary embodiment of the protective device of the present invention.
Figure 2:
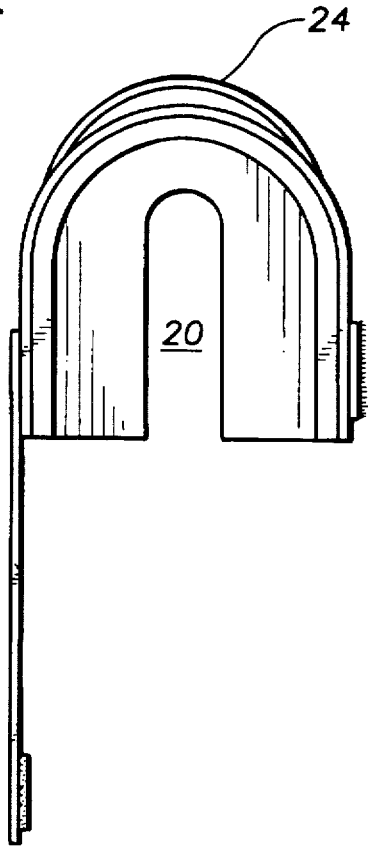
FIG. 2 is a top view of the protective device of FIG. 1 more clearly illustrating the heel slot formed through the bottom member and the sealable pouch.

FIG. 1 shows a perspective view of an exemplary embodiment of the protective device of the present invention, generally referenced by the numeral 10. Protective device 10 includes a cover member, generally referenced by the numeral 12; two adjustable straps 14,16 that are utilized to secure cover member 12 to a footwear article in use; a sealable pouch, generally designated 17; and a treated polishing cloth 19 (FIG. 2D).

Cover member 12 includes a recessed area 18 for receiving at least a portion of the heel and back of a footwear article. An elongated heel slot 20 is formed through a bottom member 22 that forms part of cover member 12. Heel slot 20 has a width of about one (1") inch and a length of about two and one-half (2½") inches. In this embodiment, the terminal end 24 of heel slot 20, (shown in FIG. 2), is curved to reduce damage to the back portion of the high heel during use.

With reference once again to FIG. 1, cover member 12 is constructed of an outer U-shaped member 26 having a curved exterior surface 21, an inner U-shaped member 28, and bottom member 22. Inner U-shaped member is constructed from a resilient plastic foam that has been covered with a nylon fabric and glued to the interior of outer U-shaped member 26. As discussed herein above, inner U-shaped member 28 is sized to receive the heel and a portion of the back of a boot or the like. In this embodiment, inner U-shaped member is about three (3") inches wide and three and one-half (3½") inches deep.

Outer U-shaped member 26 is constructed from a hard plastic material and includes two section 30,32 of loop material, secured adjacent a first outer edge 34, and two securing straps 14,16 secured adjacent a second outer edge 36. Securing straps 14,16 include sections, 38,40 respectively, of hook material at distal ends thereof. Cover member 12 is securable to a footwear article by looping straps 14,16 about the article and securing hook sections 38,40 to loop sections 30,32.

Figure 2A:
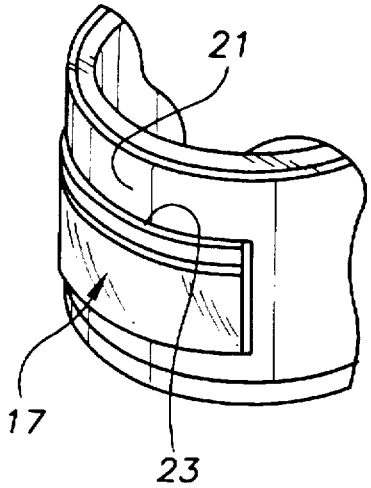
FIG. 2A is a detail perspective view of the sealable pouch in the seal configuration secured to the curved exterior portion of the cover member.
Figure 2B:
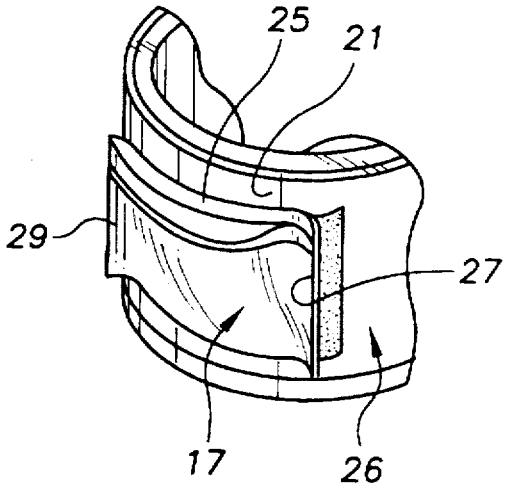
FIG. 2B is a detail perspective view of the sealable pouch in the open configuration with the first and second side portions pulled free of the first and second restickable adhesive sections formed on the exterior surface of the cover member.
Figure 2C:
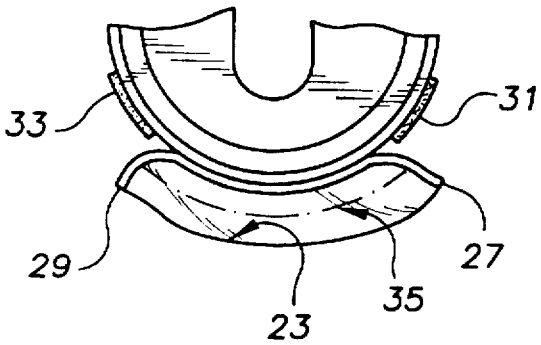
FIG. 2C is a top plan view of the sealable pouch in the open configuration with the first and second side portions pulled free of the first and second restickable adhesive sections.
Figure 2D:
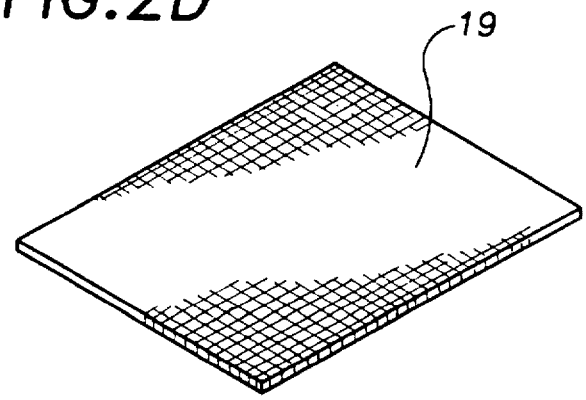
FIG. 2D is a perspective view of an exemplary embodiment of the treated polishing cloth provided in this exemplary embodiment of the embodiment and sealable within the sealable pouch.

Referring now to FIG. 2A, sealable pouch 17 is a conventional heavy-duty plastic film pouch with a zip sealable top closure, generally designated 23. Referring to FIG. 2B, sealable pouch 17 is used to store treated polishing cloth 9 (FIG. 2D) for use when desired to touch-up scuffs etc to the footwear article. Sealable pouch 17 has a central portion 25 that is permanently affixed to curved exterior surface 21 of outer U-shaped member 26. First and second side portions 27,29 are detachably securable to exterior surface al by, with reference now to FIG. 2C, first and second restickable adhesive sections 31,33. By providing detachable securement of first and second side portions 27,29, sealable closure 23 is allowed to open sufficiently to insert and retrieve treated polishing cloth 19 (FIG. 2D) through an access opening 35. Referring to FIG. 2D, in this embodiment treated polishing cloth 9 is a section of conventional woven fabric impregnated with a silicon polishing agent.

Figure 3:
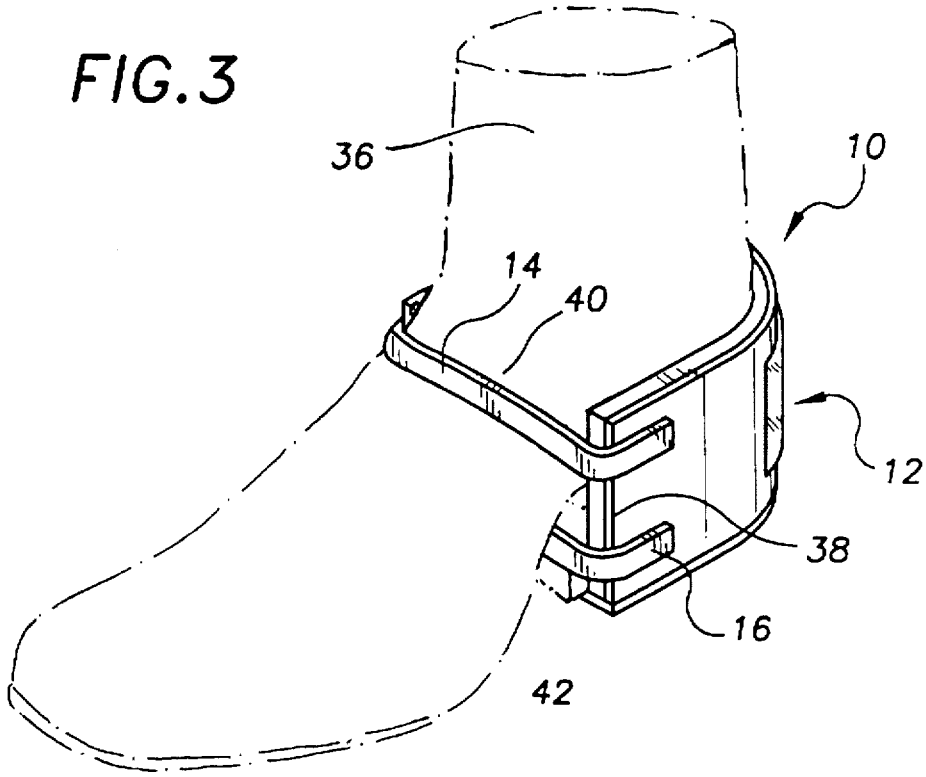
FIG. 3 is a perspective view of the protective device of FIG. 1 in use with a representative boot illustrating the over and under securing arrangement provided by the two securing straps.

FIG. 3 is a perspective view of protective device 10 in use with a representative boot 36 illustrating the over and under securing arrangement provided by securing straps 14,16. As shown, a heel 38 of boot 36 is disposed within cover member 12 and secured in place by securing strap 14, which is strapped over the top 40 of boot 36, and securing strap 16, which is secured across the front portion 42 of heel 38.

Figure 4:
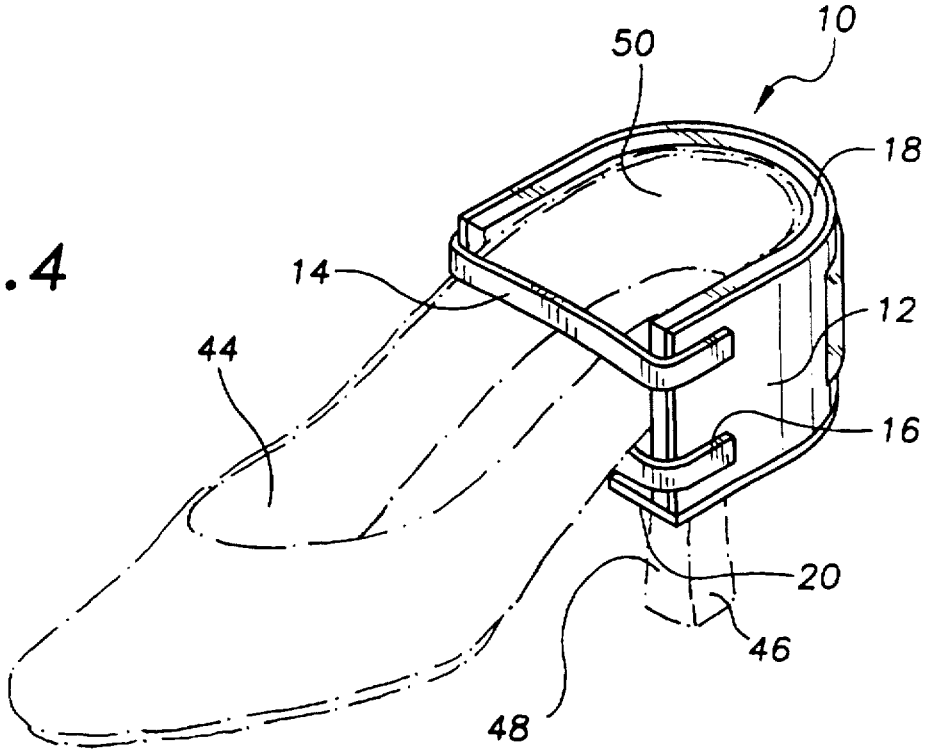
FIG. 4 is a perspective view of the protective device of FIG. 1 in use with a representative shoe having a high heel illustrating a portion of the high heel disposed through the heel slot and the back portion of the shoe received within the padded recessed area of the cover member.

FIG. 4 shows protective device 10 in use with a second representative shoe 44 of the type having a high heel 46. In the figure, a portion 48 of high heel 46 is disposed through the heel snot 20 and a back portion 50 of shoe 44 is received within the padded recessed area 18 of cover member 12. Protective device 10 is secured to shoe 44 using securing straps 14, 16 in the identical manner described above.

It can be seen from the preceding description that a protective device that protects the heel and back portion of an article of footwear from premature wear caused by operating a motor vehicle; that can be utilized with various types of footwear articles without modification of the protective device been provided; that includes a sealable pouch containing a treated polishing cloth that is easily removed from the pouch, used and then reinserted into the sealable pouch for use at a later time; and that includes a sealable pouch having a central portion permanently affixed to a curved exterior surface of the protective device and two side portions that are detachably securable to the curved exterior surface of the protective device with a restickable adhesive.

It is noted that the embodiment of the heel protector described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A heel protector comprising:

a cover member having a curved exterior surface portion and a recessed area sized to receive at least a portion of a heel and back section of a footwear article, said recessed area being partially defined by a bottom member having an elongated heel slot formed therethrough from a front edge of said bottom member toward a back edge of said bottom member said slot being of a width sufficient to allow a high heel to be inserted laterally into said slot;

a first adjustable strap assembly securable between a first side edge and a second side edge of said cover member;

a second adjustable strap assembly securable between said first side edge and said second side edge of said cover member; and a sealable pouch having a central portion permanently affixed to said curved exterior surface portion of said cover member and two side portions that are detachably securable to said curved exterior surface portion of said cover member with a restickable adhesive.

2. The heel protector of claim 1, further including:

a polishing cloth positioned within said sealable pouch.

3. The heel protector of claim 1, wherein:

said first adjustable strap assembly includes a first elongated strap member, having a first end secured to said cover member adjacent said first side edge and a second end having a first strap section of hook and pile fastener attached thereto, and a first cover member section of hook and pile fastener secured to said cover member adjacent said second side edge of said cover member; and said second adjustable strap assembly includes a second elongated strap member, having a third end secured to said cover member adjacent said first side edge and a fourth end having a second strap section of hook and pile fastener attached thereto, and a second cover member section of hook and pile fastener secured to said cover member adjacent said second side edge of said cover member.

4. The heel protector of claim 1, wherein:

said surface of said cover member defining said recessed area is covered with a padding material.

5. The heel protector of claim 1 wherein:

said slot is between three-quarters of one inch and two inches in width.

6. The heel protector of claim 1 wherein:

said cover member includes an outer U-shaped member, an inner U-shaped member, and said bottom member; said inner U-shaped member being constructed from a resilient material and secured within said outer U-shaped member; said inner U-shaped member being sized to receive said heel and a portion of said back of said footwear article; said outer U-shaped member being constructed from a hard plastic material; said bottom member being heel shaped and secured over one side of said U-shaped inner and outer members.

7. The heel protector of claim 1 wherein:

said first adjustable strap assembly includes a first elongated scrap member, having a first end secured to said cover member adjacent said first side edge and a second end having a first strap section of hook and pile fastener attached thereto, and a first cover member section of hook and pile fastener secured to said cover member adjacent said second side edge of said cover member;

said second adjustable strap assembly includes a second elongated strap member, having a third end secured to said cover member adjacent said first side edge and a fourth end having a second strap section of hook and pile fastener attached thereto, and a second cover member section of hook and pile fastener secured to said cover member adjacent said second side edge of said cover member; and said surface of said cover member defining said recessed area is covered with a padding material.

8. The heel protector of claim 7 wherein:

said slot is between three-quarters of one inch and two inches in width.

9. The heel protector of claim 8 wherein:

said cover member includes an outer U-shaped member, an inner U-shaped member, and said bottom member; said inner U-shaped member being constructed from a resilient material and secured within said outer U-shaped member; said inner U-shaped member being sized to receive said heel and a portion of said back of said footwear article; said outer U-shaped member being constructed from a hard plastic material; said bottom member being heel shaped and secured over one side of said U-shaped inner and outer members.

10. The heel protector of claim 7 wherein:

said cover member includes an outer U-shaped member, an inner U-shaped member, and said bottom member; said inner U-shaped member being constructed from a resilient material and secured within said outer U-shaped member; said inner U-shaped member being sized to receive said heel and a portion of said back of said footwear article; said outer U-shaped member being constructed from a hard plastic material; said bottom member being heel shaped and secured over one side of said U-shaped inner and outer members.

11. The heel protector of claim 1, wherein:

said first adjustable strap assembly includes a first elongated strap member, having a first end secured to said cover member adjacent said first side edge and a second end having a first strap section of hook and pile fastener attached thereto, and a first cover member section of hook and pile fastener secured to said cover member adjacent said second side edge of said cover member;

said second adjustable strap assembly includes a second elongated strap member, having a third end secured to said cover member adjacent said first side edge and a fourth end having a second strap section of hook and pile fastener attached thereto, and a second cover member section of hook and pile fastener secured to said cover member adjacent said second side edge of said cover member; and said slot is between three-quarters of one inch and two inches in width.

12. The heel protector of claim 11 wherein:

said cover member includes an outer U-shaped member, an inner U-shaped member, and said bottom member; said inner U-shaped member being constructed from a resilient material and secured within said outer U-shaped member; said inner U-shaped member being sized to receive said heel and a portion of said back of said footwear article; said bottom member being heel shaped and secured over one side of said U-shaped inner and outer members.

13. A heel protector comprising:

a cover member having a curved exterior surface portion and a recessed area sized to receive at least a portion of a heel and back section of a footwear article, said recessed area being partially defined by a bottom member having an elongated heel slot formed therethrough from a front edge of said bottom member toward a back edge of said bottom member said slot being of a width sufficient to allow a high heel to be inserted laterally into said slot in a manner such that the back of the shoe to which the high heel is attached is disposed within a padded recessed area;

a first adjustable strap assembly securable between a first side edge and a second side edge of said cover member;

a second adjustable strap assembly securable between said first side edge and said second side edge of said cover member; and a sealable pouch having a central portion permanently affixed to said curved exterior surface portion of said cover member and two size portions that are detachably securable to said curved exterior surface portion of said cover member with a restickable adhesive;

said first adjustable strap assembly including a first elongated strap member, having a first end secured to said cover member adjacent said first side edge and a second end having a first strap section of hook and pile fastener attached thereto, and a first cover member section of hook and pile fastener secured to said cover member adjacent said second side edge of said cover member;

said second adjustable strap assembly Including a second elongated strap member, having a third end secured to said cover member adjacent said first side edge and a fourth end having a second strap section of hook and pile fastener attached thereto, and a second cover member section of hook and pile fastener secured to said cover member adjacent said second side edge of said cover member;

said slot being between three-quarters of one inch and two inches in width;

said cover member including an outer U-shaped member, an inner U-shaped member, and said bottom member; said inner U-shaped member being constructed from a resilient material and secured within said outer U-shaped member; said inner U-shaped member being sized to receive said heel and a portion of said back of said footwear article; said outer U-shaped member being constructed from a hard plastic material; said bottom member being heel shaped and secured over one side of said U-shaped inner and outer members.

14. The heel protector of claim 13, further including:

a polishing tooth positioned within said sealable pouch.

* * * * *